US007547013B2

(12) United States Patent
Matsumoto

(10) Patent No.: US 7,547,013 B2
(45) Date of Patent: Jun. 16, 2009

(54) SHEET FEEDING APPARATUS CAPABLE OF SETTING A SHEET TRAY WITH REDUCED FORCE

(75) Inventor: Taizo Matsumoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 11/503,923

(22) Filed: Aug. 15, 2006

(65) Prior Publication Data

US 2007/0102868 A1 May 10, 2007

(30) Foreign Application Priority Data

Nov. 10, 2005 (JP) ..... 2005-326203
Jun. 20, 2006 (JP) ..... 2006-169630

(51) Int. Cl.
*B65H 1/08* (2006.01)

(52) U.S. Cl. ..... 271/127; 271/145; 271/162; 271/164

(58) Field of Classification Search ..... 271/127, 271/145, 162, 164
See application file for complete search history.

(56) References Cited

U.S. PATENT DOCUMENTS 4,763,891 A * 8/1988 Kodama ..... 271/157
5,100,122 A * 3/1992 Noda et al. ..... 271/155
5,149,079 A * 9/1992 Iwamoto et al. ..... 271/162
5,170,950 A * 12/1992 Okitsu et al. ..... 271/127
5,195,734 A * 3/1993 Tanabe ..... 271/9.03
5,451,039 A * 9/1995 Adachi ..... 271/9.06
5,470,052 A * 11/1995 Asakawa et al. ..... 271/118
5,480,131 A * 1/1996 Furukawa et al. ..... 271/9.06
5,725,208 A * 3/1998 Miyauchi ..... 271/10.09
5,775,686 A * 7/1998 Miyake ..... 271/127
5,794,928 A * 8/1998 Araseki et al. ..... 271/9.08
5,882,003 A * 3/1999 Fujiwara et al. ..... 271/10.11
5,887,867 A * 3/1999 Takahashi et al. ..... 271/117
5,897,110 A * 4/1999 Fujiwara ..... 271/4.01
5,909,872 A * 6/1999 Takahashi ..... 271/116
6,123,329 A * 9/2000 Sato et al. ..... 271/9.01
6,224,051 B1 * 5/2001 Nakayama et al. ..... 271/115
6,523,821 B2 * 2/2003 Kashiwagi et al. ..... 271/145
6,862,426 B2 * 3/2005 Kitamura ..... 399/393
2004/0041333 A1 * 3/2004 Izumi et al. ..... 271/145
2005/0151314 A1 * 7/2005 Park ..... 271/121
2006/0244200 A1 * 11/2006 Someya et al. ..... 271/145
2007/0001380 A1 * 1/2007 Kusumi ..... 271/157

FOREIGN PATENT DOCUMENTS

JP 7-196174 8/1995
JP 8-73074 3/1996
JP 9-301552 11/1997
JP 3176455 4/2001
JP 3182251 4/2001
JP 2001-240260 9/2001
JP 2005178925 A * 7/2005
JP 2005263417 A * 9/2005

* cited by examiner

*Primary Examiner*—Patrick H Mackey
*Assistant Examiner*—Howard Sanders
(74) *Attorney, Agent, or Firm*—Oblon, Spivak, McClelland, Maier & Neustadt, P.C.

(57) ABSTRACT

A sheet feeding apparatus, having detachable and attachable sheet trays, a linkage mechanism between the sheet feeding apparatus and the sheet tray, and that can attach the sheet tray to the sheet feeding apparatus with a reduced force.

7 Claims, 9 Drawing Sheets

SHEET FEEDING APPARATUS CAPABLE OF SETTING A SHEET TRAY WITH REDUCED FORCE

CROSS-REFERENCE TO RELATED APPLICATIONS

This patent specification is related to and claims priority under 35 U.S.C. §119 to Japanese patent applications No. 2005-326203, filed on Nov. 10, 2005 and No. 2006-169630 filed on Jun. 20, 2006, in the Japanese Patent Office, the entire contents of each of which are hereby incorporated herein by reference.

BACKGROUND OF THE INVENTION

1. Field of the Invention

This invention relates to a detachable and attachable sheet tray for a printing device. The sheet tray includes a sheet setting board on which a plurality of sheets are set. The sheet setting board is moved up and down by a linkage between a first linkage member in the sheet tray and a second linkage member in the printing device. The position of the second linkage member is adjusted corresponding to the position of the first linkage member while the sheet tray is detached from the printing device.

2. Description of the Background Art

To make use of a printing device easier for a user with disabilities, section 508 of the Rehabilitation act has been established. The regulation requires "products which have mechanically operated controls or keys shall comply with the following: Controls and keys shall be operable with one hand and shall not require tight grasping, pinching, twisting of the wrist. The force required to activate controls and keys shall be 5 lbs. (22.2N) maximum".

But so far in conventional printing devices, this regulation has not been significantly considered. Therefore, the force for setting a sheet tray into a printing device sometimes exceeds the noted regulation.

Typical printing devices of this type are disclosed, for instance, in Japanese Patent No. 3176455 and Japanese Open-Laid Patent H07-196174.

Printing devices of this type include sheet trays that have to be pulled out from a printing device to add some sheets. After sheets are supplied, the sheet tray is pushed back into the printing device. A sheet setting board is provided at a side of such a sheet tray on which a plurality of sheets are set. The sheet setting board has a shaft at the opposite side of the sheet feeding direction. The shaft is linked to a coupling in the printer device by a pin attached to the shaft and a groove on the coupling. A motor in the printing device rotates the coupling, and the coupling conveys the rotation to the shaft through the linkage. With the rotation of the shaft, the sheet setting board makes a pivot movement. By pivoting around the shaft, the sheet setting board is moved up and the position of the uppermost sheet of the plurality of the sheets on the paper setting board is maintained regardless of the amount of remaining sheets.

Detachment between the sheet tray and the printing device occurs between the pin and the groove. After the pin is detached from the groove the sheet setting board goes down by its weight, but if a position of the coupling is not controlled that causes a position inconsistence between the pin and the coupling.

If the sheet tray is pushed into the printing device under that condition, the pin collides with the coupling. The coupling is fixed to a motor shaft with a spring and can move parallel to the motor shaft. Therefore, the coupling is pushed and moves to the printing device. As a result, the position difference requires more power to push in the sheet tray to the printing device for operators.

SUMMARY OF THE INVENTION

In light of the recognition of above described problem by the present inventors, the present invention is directed to a sheet feeding apparatus capable of setting the sheet tray with reduced force. For example, the sheet feeding apparatus includes a detachable and attachable sheet tray including a first linkage member and a sheet setting board, a second linkage member linked to the first linkage member to convey a rotating force to the first linkage member, a motor that rotates the second linkage member, and a controller that controls the motor rotation. The controller controls the motor rotation to adjust the position of the second linkage member to correspond to the position of the first linkage member while the sheet tray is detached from the sheet feeding apparatus. Therefore, the force for putting in the sheet tray to the sheet feeding apparatus is reduced and satisfies the requirement of the section 508 of the Rehabilitation act.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
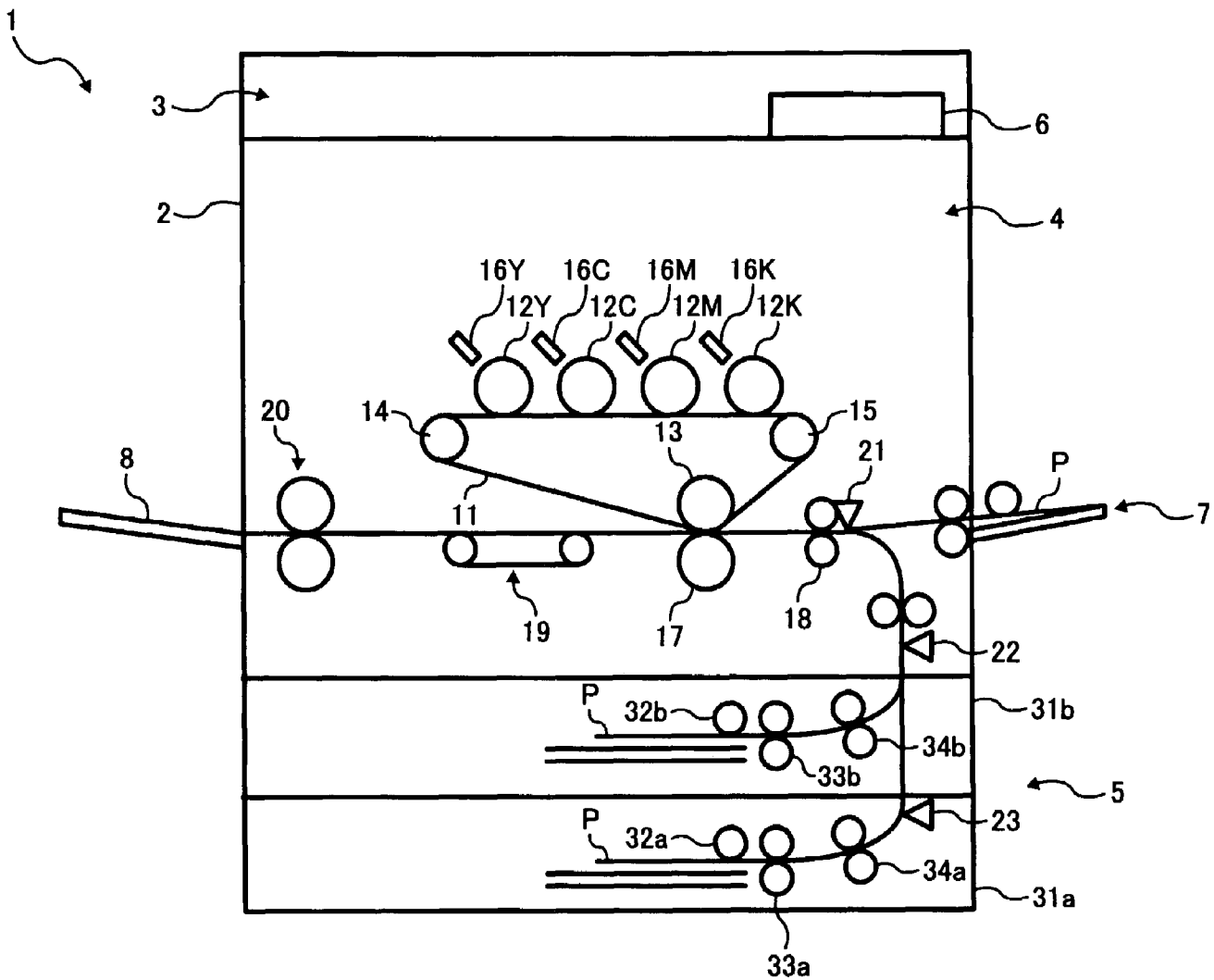
FIG. 1 is a perspective view illustrating a structure or main parts of a color printing apparatus.

Referring to FIG. 1, a color printing apparatus 1 is explained. As illustrated in FIG. 1, the color printing apparatus 1 includes a main housing 2, an image scanner 3 on the main housing 2, an image forming unit 4 in the main housing 2, a sheet feeder 5 under the image forming unit 4, an operation panel 6 also located on the main housing 2, a manual sheet feeder 7 on the right side of the main housing 2, and a sheet discharge unit 8 on the left side of the main housing 2.

The operation panel 6 includes keys and a display (for example a Liquid Crystal Display (LCD)). An operator can set some operating modes through the keys on the operational panel 6 and the display shows information from the color printing apparatus 1, such as information about remaining sheets, the size of the sheet in the sheet feeder 5, etc.

The image scanner 3 scans an original in a main scanning direction and a sub scanning direction and outputs digital image data corresponding to the original.

The image forming unit 4 is provided with an image forming mechanism, which is further explained below. Photosensitive drums 12Y for yellow (Y), 12C for cyan (C), 12M for magenta (M), and 12K for black (K) are placed in this order from left to right shown in FIG. 1 along a transfer belt 11. The transfer belt 11 is formed seamless and supported by tension rollers 13, 14, and 15. At least one of the tension rollers 13, 14, and 15 provides a driving force to the transfer belt 11 and the transfer belt 11 rotates clockwise.

Around the photosensitive drums 12Y, 12C, 12M, and 12K, charger units (not shown), optical writing units 16Y, 16C, 16M, and 16K, developing units (not shown), transfer units (not shown), cleaning units (not shown), and discharge units (not shown) are arranged.

After the charging units evenly charge surfaces of the photosensitive drums 12Y, 12C, 12M, and 12K, the optical writing units 16Y, 16C, 16M, and 16K scan surfaces of the rotating photosensitive drums 12Y, 12C, 12M, and 12K with laser beams modulated in accordance with the respective color data read by image scanner 3 to form electrostatic latent images of the Y, C, M, and K colors on the respective photosensitive drums 12Y, 12C, 12M, and 12K. The developing units develop the electrostatic latent images on the photosensitive drums 12Y, 12C, 12M, and 12K with the Y, C, M, and K color toners and form the Y, C, M, and K toner images. The transfer units transfer the toner images on the photosensitive drums 12Y, 12C, 12M, and 12K sequentially to the transfer belt 11 and consequently the Y, C, M, and K color toner images are in turn over laid so as to form a full color toner image on the transfer belt 11.

The image forming unit 4 is also provided with a transfer roller 17, a registration roller pair 18, a conveying unit 19, and a fixing unit 20. A recording sheet P is sent from the manual sheet feeder 7 or the sheet feeder 5. Along the path through which the recording sheet passes, sheet sensors 21, 22, and 23 are provided. The sheet sensor 21 detects both the leading edge and the trailing edge of the recording sheet P coming to the registration roller pair 18, and the sheet sensors 22 and 23 detect both the leading and the trailing edges of the recording sheet P coming from the sheet feeder 5.

At the registration roller pair 18, the recording sheet P is stopped and a flexure is formed to correct any slant. After the slant correction is performed, the recording sheet P is sent between the transfer belt 11 and transfer roller 17, and the transfer roller 17 transfers the full color toner image on the transfer belt 11 to the recording sheet P. The conveying unit 19 conveys the recording sheet P with the full color toner image to the fixing unit 20, and the fixing unit 20 applies pressure and heat to fix the color toner image to the recording sheet P permanently. The recording sheet P with the fixed full color toner image is then discharged from the discharge unit 8.

Figure 2:
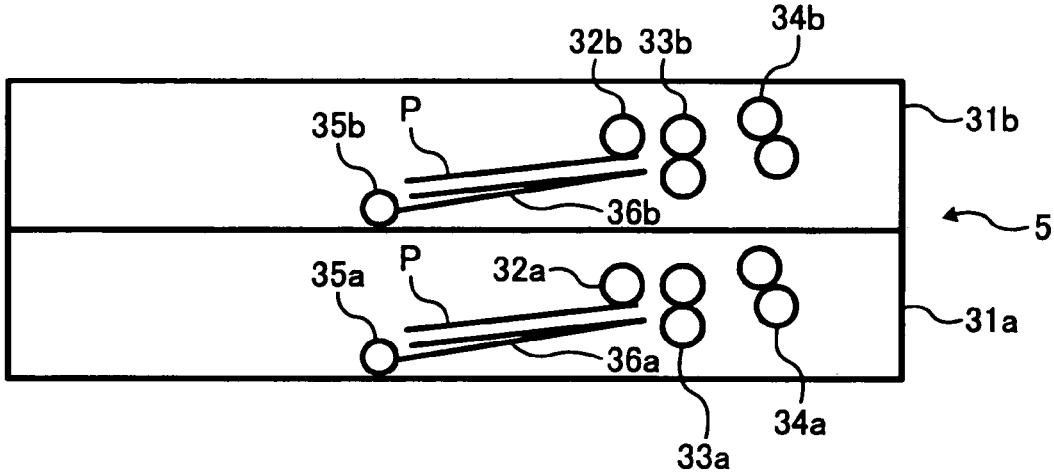
FIG. 2 is a perspective view illustrating a detailed structure of a sheet feeder of the color printing apparatus of FIG. 1.

Referring FIG. 2, the sheet feeder 5 is explained in further detail. As shown in FIG. 2, the sheet feeder contains two sheet trays 31*a* and 31*b*. Each sheet tray can hold a plurality of recording sheets and is provided with respective pickup rollers 32*a*, 32*b*, a separating roller pair 33*a*, 33*b*, and a feeding roller pair 34*a*, 34*b*. The pickup roller pairs 32*a*, 32*b* pick up some recording sheets from the top and send the recording sheets to the separating roller pair 33*a*, 33*b*. Each separating roller pair 33*a*, 33*b* separates the uppermost sheet and other sheets and sends the uppermost recording sheet to the respective feeding roller pair 34*a*, 34*b*. Then the feeding roller pair 34*a*, 34*b* feeds the recording sheet P toward the registration roller pair 18.

The sheet trays 31*a*, 31*b* can be pulled out from the main frame 2 to be filled with the recording sheets. After adding the recording sheets, the sheet trays 31*a*, 31*b* can be pushed back into the main frame 2 to be ready for use.

Figure 3:
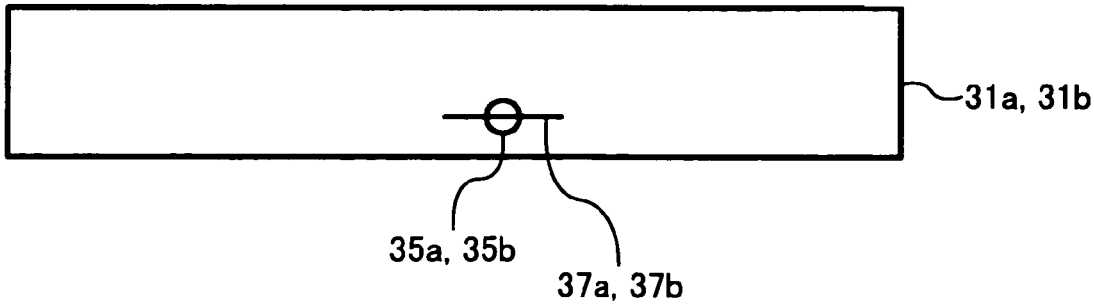
FIG. 3 is a perspective view from a rear side illustrating positional relations of a pin, a shaft, and a sheet tray.
Figure 4:
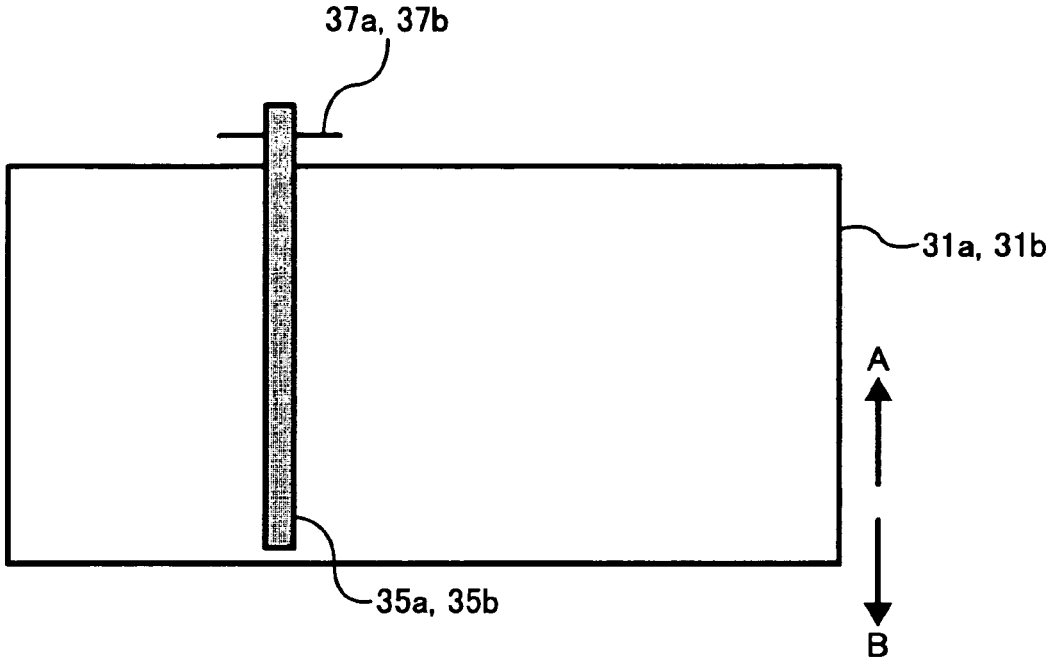
FIG. 4 is a perspective view from an upper side illustrating positional relations of the pin, the shaft, and the sheet tray.

The sheet trays 31*a*, 31*b* are also respectively provided with a sheet setting board 36*a*, 36*b*, which has a shaft 35*a*, 35*b* at the opposite end for the sheet feeding direction. Each shaft 35*a*, 35*b* is attached to the sheet tray 31*a*, 31*b* and is rotatable. A stack of recording sheets is set on the sheet setting boards 36*a*, 36*b*. As shown in FIG. 3 and FIG. 4, respective pins 37*a*, 37*b* are fixed to the shafts 35*a*, 35*b* at the end of the shafts 35*a*, 35*b*, where each pin 37*a*, 37*b* is attached to, and sticks out from, the side fence of the respective sheet tray 31*a*, 31*b*. As shown in FIG. 3, each pin 37*a*, 37*b* becomes level when the sheet setting board 36*a*, 36*b* is in the lowest position. When the sheet tray 31*a*, 31*b* is pulled out from the main frame 2, the respective sheet setting board 36*a*, 36*b* goes down to the lowest position (the home position) by its weight. The arrow A in FIG. 4 shows the direction for setting each sheet tray 31*a*, 31*b* to the main frame 2 and the arrow B in FIG. 4 shows the direction for pulling out each sheet tray 31*a*, 31*b* from the main frame 2.

Figure 5:
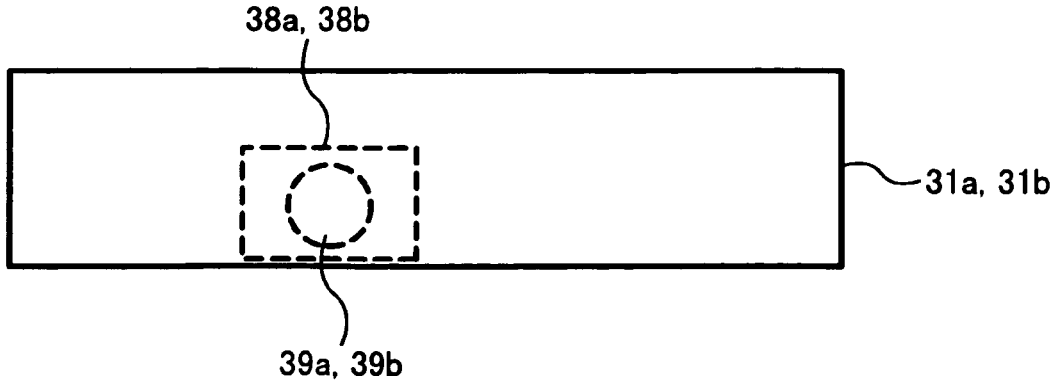
FIG. 5 is a perspective view illustrating positional relations of a coupling, a motor, and a sheet tray.
Figure 6:
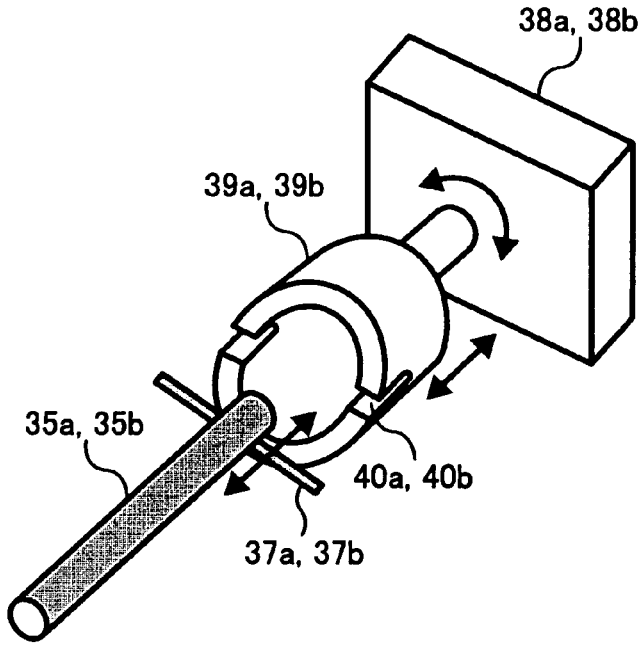
FIG. 6 is a detailed structure illustrating a linkage mechanism between the motor, the coupling, the pin, and the shaft.

Referring for FIG. 5, the color printing apparatus 1 is provided with a respective driving motor 38*a*, 38*b* at the place where each of the sheet trays 31*a*, 31*b* is placed, and each driving motor 38*a*, 38*b* is provided with a respective coupling 39*a*, 39*b* on the end of its rotating shaft. As shown in FIG. 6, a coupling groove 40*a*, 40*b* is formed on each respective coupling 39*a*, 39*b*. When each sheet tray 31*a*, 31*b* is pushed into the main housing 2, the respective coupling groove 40*a*, 40*b* on the respective coupling 39*a*, 39*b* can be linked with the pin 37*a*, 37*b* on the shaft 35*a*, 35*b*. While the linkage is secured and the driving motor 38*a*, 38*b* turns on, the rotating force is respectively conveyed from the coupling 39*a*, 39*b* through the coupling groove 40*a*, 40*b*, the pin 37*a*, 37*b*, and the shaft 35*a*, 35*b*, to the sheet setting board 36*a*, 36*b*, and thereby the sheet setting board 36*a*, 36*b* is lifted until the uppermost recording sheets P of the plurality sheets on the sheet setting board 36*a*, 36*b* reaches the pickup roller 32*a*, 32*b*.

If the respective pin 37*a*, 37*b* of the shaft 35*a*, 35*b* and the coupling groove 40*a*, 40*b* on the coupling 39*a*, 39*b* cannot link when the sheet tray 31*a*, 31*b* is pushed into the main housing 2, then the coupling 39*a*, 39*b*, which is movably attached to the driving motor 38*a*, 38*b* by a spring (not shown), can move in the direction of the arrow shown in FIG. 6. In that case, each sheet tray 31*a*, 31*b* needs to be pushed harder to settle in the main housing 2.

To avoid that situation, in the present invention if the respective sheet tray 31*a*, 31*b* is set to the main housing 2 without the proper connection of linkage between the pin 37*a*, 37*b* and the coupling groove 40*a*, 40*b*, the driving motor 38*a*, 38*b* can be turned on and the coupling 39*a*, 39*b* can be rotated. By rotating each coupling 39*a*, 39*b*, the position of the coupling groove 40*a*, 40*b* can be made to coincide with the position of the pin 37*a*, 37*b* in the end, and then the linkage is restored.

Figure 7:
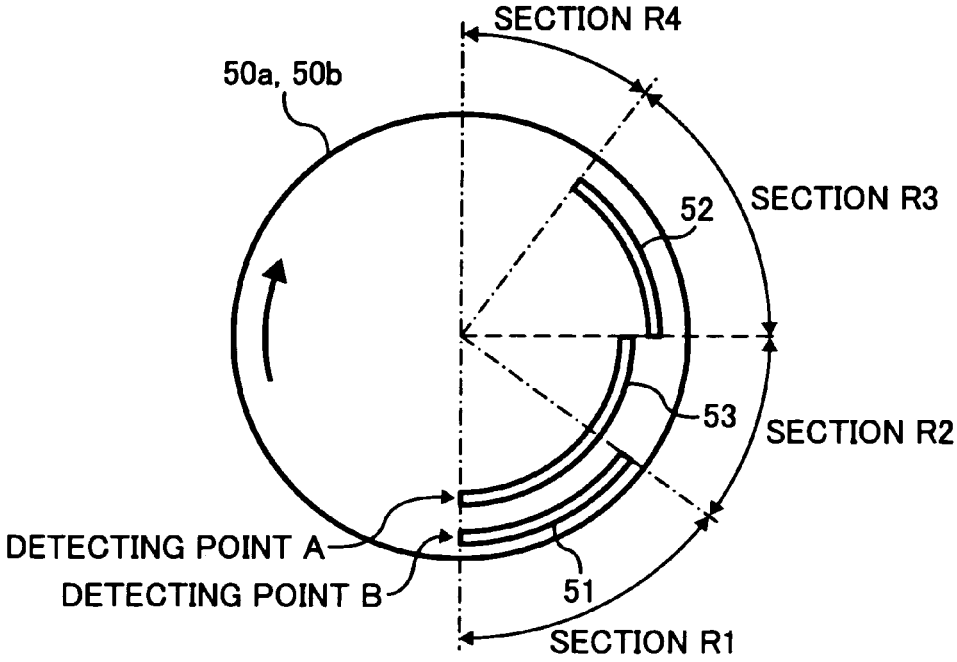
FIG. 7 is a detailed description illustrating a rotating disk and slits on the disk.

As each sheet setting board 36*a*, 36*b* is moved up by the respective driving motor 38*a*, 38*b*, a respective disk 50*a*, 50*b* rotates clockwise as shown in FIG. 7. On each disk 50*a*, 50*b*, arc shaped slits 51, 52, and 53 are formed to detect the rotating angle of the respective shaft 35*a*, 35*b*. The slits 51, 52 have the same radius, but the slit 53 has a different radius than the slits 51 and 52; the radius of the slit 53 is shorter than of the slits 51, 52. As for the length, the length of the slits 51, 52 are the same, but the length of the slit 53 is longer than of the slits 51 and 52.

The position shown in FIG. 7 is a home position of each disk 50*a*, 50*b*, which corresponds to the home position of the respective coupling groove 40*a*, 40*b* and the sheet setting board 36*a*, 36*b*.

Figure 8A:
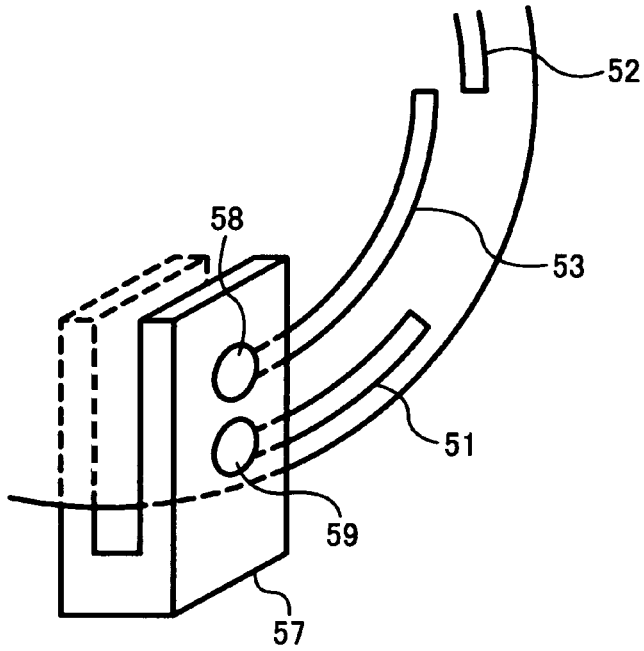
FIG. 8A is a detailed description illustrating the rotating disk with a position detector and a home position detector.

Referring FIG. 8A, the slits 51, 52, and 53 are detected by a position detector 57. The position detector 57 is provided with slit sensors 58, 59. The slit sensors 58, 59 can, e.g., employ a transmissive detector, which is a type of detector with a photo diode and a detector pointed at each other, and a target interrupts the beam path. The slit sensor 58 detects a state of the detecting point A and the slit sensor 59 detects a state of the detecting point B (both shown in FIG. 7). The state of the detecting point A, B changes depending on the position of the slits 51, 52, and 53.

The right side of each disk 50*a*, 50*b* is divided into four sections R1 to R4 by the slits 51, 52, and 53. The slit sensors 58 and 59 detect the open state if the part of the section R1 is located at the detecting positions A, B. Similarly, the slit sensor 58 detects the open state and the slit sensor 59 detects the closed state in the section R2, the slit sensor 58 detects the closed state and the slit sensor 59 detects the open state in the section R3, and the slit sensors 58 and 59 both detect the closed state in the section R4.

As explained above, the recording sheets P are fed to the image forming unit 4 one by one and the amount of the recording sheets P in the sheet trays 31*a*, 31*b* gradually reduce. To maintain the height of the recording sheets P unchanged, the driving motors 38*a*, 38*b* rotate the couplings 39*a*, 39*b* and lift the sheet setting boards 36*a*, 36*b* through the linkages between the coupling grooves 40*a*, 40*b* on the couplings 39*a*, 39*b* and the pins 37*a*, 37*b* of the shafts 35*a*, 35*b*, respectively. As the rotation of the couplings 39*a*, 39*b* cause the rotation of the disks 50*a*, 50*b*, accordingly based on the state of the positions A, B, the color printing apparatus 1 knows the angle of the sheet setting boards 36*a*, 36*b* from their home positions, which means the remaining recording sheets P in the sheet trays 31*a*, 31*b* is known.

Figure 8B:
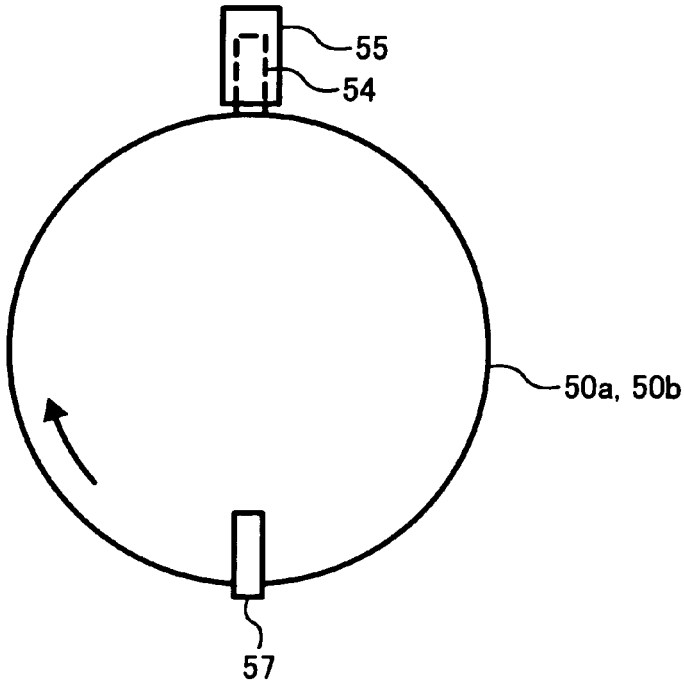
FIG. 8B is a detailed description illustrating a position detector and slits.

The disks 50*a*, 50*b* also include filler 54 as shown in FIG. 8B. A home position detector 55 detects the filler 54 when the disks 50*a*, 50*b* are in the home position. When the disks 50*a*, 50*b* are in their home position then the couplings 39*a*, 39*b* also are in their home position.

Figure 10:
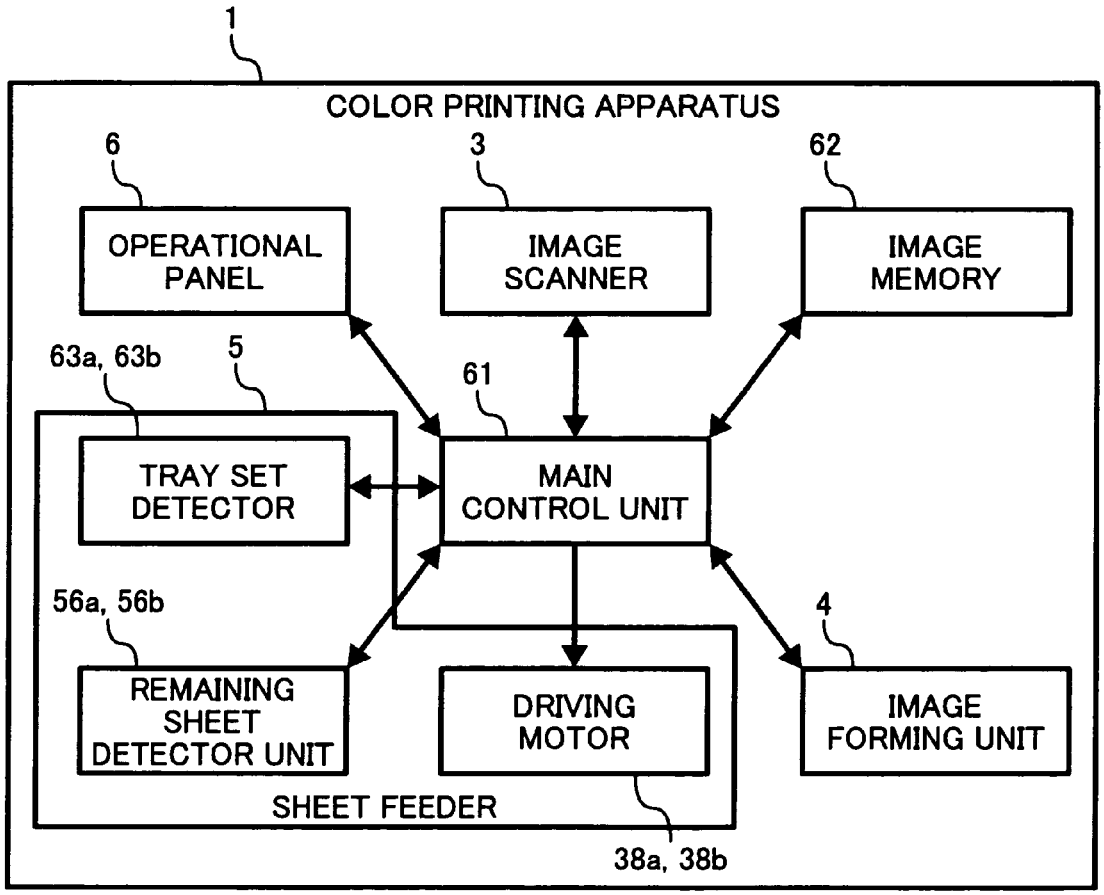
FIG. 10 is a block diagram illustrating the color printing apparatus of FIG. 1.

Both the position detector 57 and the home position detector 55 include a remaining sheets detector unit 56 shown in FIG. 10. Each remaining sheets detecting unit 56*a*, 56*b* has two functions, (1) detecting the remaining recording sheets in the sheet trays 31*a*, 31*b* and (2) detecting the home positions of the disks 50*a*, 50*b*.

Figure 9:
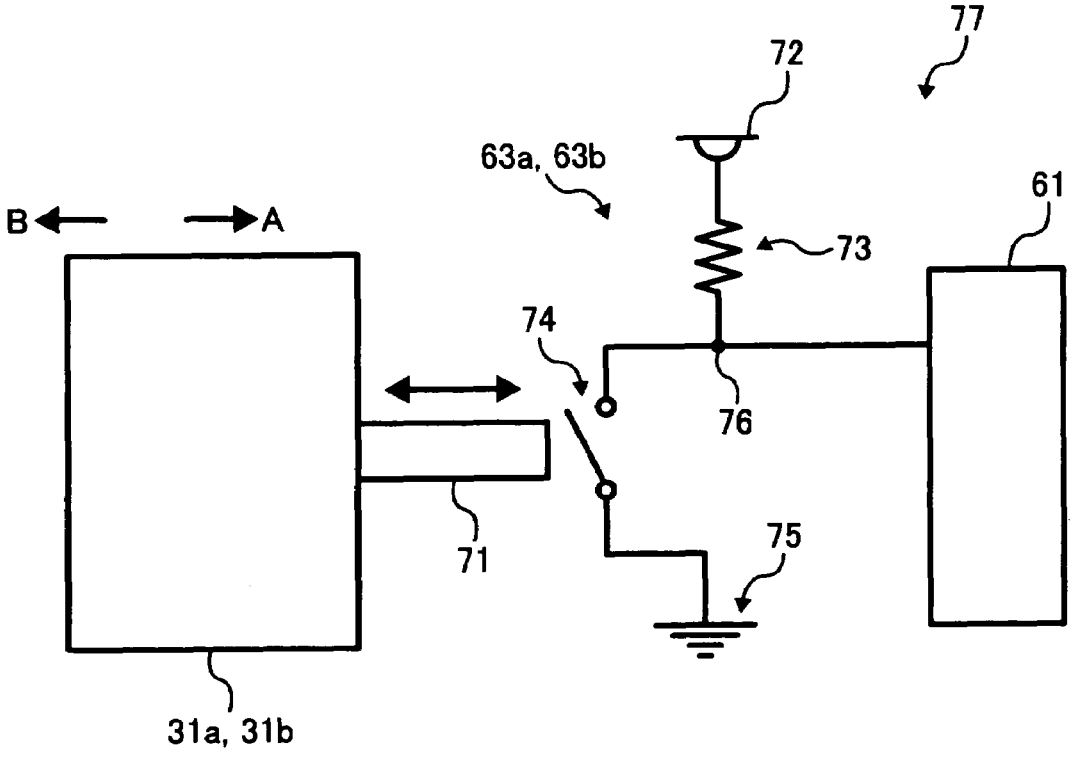
FIG. 9 is a schematic diagram illustrating a tray set detector and a pushing member attached to the sheet tray.

Referring FIG. 9, the color printing apparatus 1 also includes tray set detectors 63*a*, 63*b*. Each tray set detector 63*a*, 63*b* has two parts, a pushing member 71 on respective sheet tray 31*a*, 31*b*, and a detecting circuit 77 in the color printing apparatus 1. A pushing member 71 is movably attached to each respective sheet tray 31*a*, 31*b* by a spring (not shown). As each sheet tray 31*a*, 31*b* is pushed into the main frame 2, its respective pushing member 71 pushes a switch 74 of the detecting circuit 77. The spring mechanism enables the pushing member 71 to push the switch 74 before the sheet tray 31*a*, 31*b* is completely set to the main housing 2. One side of the switch 74 is connected to a power source (ea. +5V) 72 through a resister 73, and the other side of the switch 74 is connected to the ground 75. A main control unit 61 (shown in FIG. 10) monitors an electric potential of a detecting point 76, which is between the resister 73 and the switch 74, and detects the state of whether the sheet tray 31*a*, 31*b* is set to the main housing 2 or not by the electric potential at the detecting point 76.

When the sheet tray 31*a*, 31*b* is set to the main housing 2 and the pushing member 71 pushes the switch 74, that causes the switch 74 to come into a closed state. When the switch 74 is in the closed state, a current path exists from the power source 72 through the resister 73 and the switch 74 to the ground 75, and thereby the electric potential of the detecting point 76 becomes the ground level. As the sheet tray 31*a*, 31*b* is pulled out, the pushing member 71 does not push the switch 74, and that causes the state of the switch 74 to be in the open state. In the open state the switch 74 cuts the current path and the electric potential of the detecting point 76 becomes almost +5V. Namely, the difference of the electric potential of the detecting point 76 indicates the state of whether the sheet tray 31*a*, 31*b* is attached to or detached from the main housing 2.

FIG. 10 shows a block diagram of the color printing apparatus 1. The color printing apparatus includes the image scanner 3, the image forming unit 4, the operational panel 6, the main control unit 61, an image memory unit 62, and the sheet feeder 5. The sheet feeder 5 includes the driving motors 38*a*, 38*b*, the remaining sheets detector units 56*a*, 56*b*, and the tray set detectors 63*a*, 63*b*.

The main control unit 61 includes (although not shown) a CPU (Central Processing Unit), a ROM (Read Only Memory), a RAM (Random Access Memory), and controls every part of the color printing apparatus 1 based on, e.g., programs in the ROM. The main control unit 61 also executes the position adjustment procedure between the coupling grooves 40*a*, 40*b* on the couplings 39*a*, 39*b* and the pins 37*a*, 37*b* on the shafts 35*a*, 35*b* related to this invention.

The memory unit 62 includes, e.g., (although not shown) a HDD (Hard Disk Drive) or a large capacity RAM, and stores image data of the original read by the image scanner 3.

The main control unit 61 receives a signal from the tray set detectors 63*a*, 63*b*, which shows the state of whether the sheet trays 31*a*, 31*b* are in their home positions or not. The main control unit 61 also receives signals from the home position detector 55 and the position detector 54, and such signals show whether the disks 50*a*, 50*b* are in their home positions and the rotating angle of the disks 50*a*, 50*b* from their home positions. And the disks 50*a*, 50*b* rotate corresponding to the rotation of the couplings 39*a*, 39*b*, and therefore the main control unit 61 detects whether the couplings 39*a*, 39*b* are in their home position.

Figure 11:
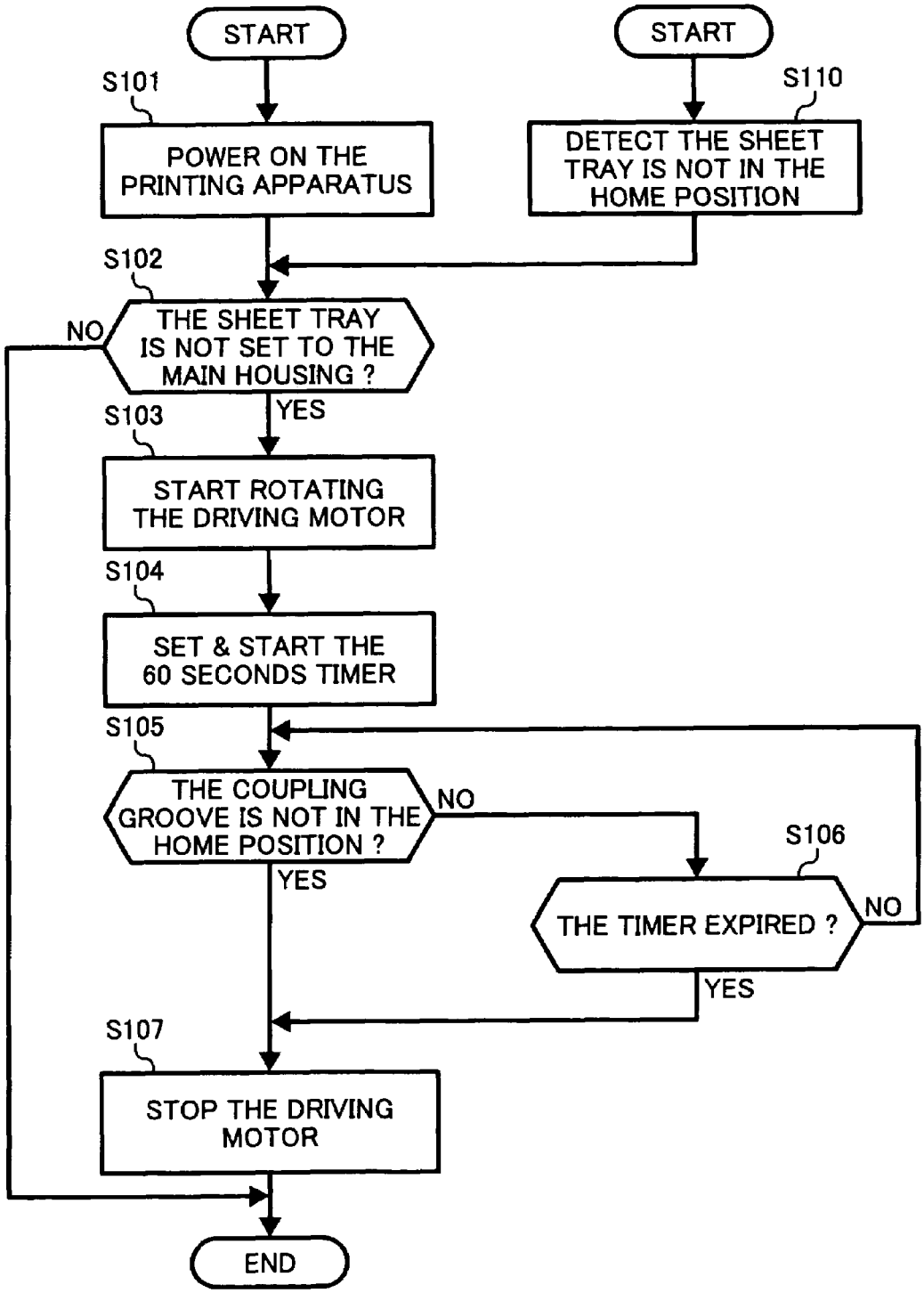
FIG. 11 is a flowchart illustrating a first embodiment of a position adjustment procedure.

FIG. 11 shows an exemplary procedure for controlling the position adjustment between the coupling grooves 40*a*, 40*b* on the couplings 39*a*, 39*b* and the pins 37*a*, 37*b* on the shafts 35*a*, 35*b* to reduce the force for pushing the sheet trays 31*a*, 31*b* into the main housing 2.

In step S101 of the flowchart shown in FIG. 11, a power switch (not shown) of the color printing apparatus 1 is turned on and a power source is supplied to the color printing apparatus 1. In step S102, the main controlling unit 61 determines whether the sheet tray 31*a* or 31*b* is pulled out from the main housing 2 by the output signal from the tray set detector 63*a* or 63*b*. In step S102, if the main controlling unit 61 detects neither of the sheet trays 31*a* nor 31*b* is pulled out from the main housing 2, No in step S102, then the main controlling unit 61 ends the position adjustment procedure. But if the main controlling unit 61 detects one of the sheet tray 31*a* and 31*b* is pulled out from the main housing 2, Yes in step S102, then the main controlling unit 61 initiates a position adjustment procedure. From here an explanation is made based on the case that the sheet tray 31*a* is detached.

In step S103, the main controlling unit 61 starts to rotate the driving motor 38*a* corresponding to the pulled out tray 31*a*, and in step S104 the main controlling unit 61 sets and starts a 60 second internal timer to detect errors in a rotation of the driving motor 38*a*. In step S105, the main controlling unit 61 determines whether the home position of the disk 50*a* is detected or not by using the output signal from the home position detector 55. If the main controlling unit 61 detects the home position of the disk 50*a*, Yes in step S105, then the position of the coupling groove 40*a* on the coupling 39*a* is also in the home position. Therefore, the main controlling unit 61 detects that the position adjustment of the coupling groove 40*a* has finished, so the operation proceeds to step S107, and the rotation of the driving motor 38*a* is stopped and the position adjustment procedure is ended. If the main controlling unit 61 does not detect the home position of the disk 50*a*, No in step S105, then the operation proceeds to step S106 in which the main controlling unit 61 determines whether the 60 seconds timer has expired or not. If the 60 seconds timer has not expired, No in step S106, then the operation returns to step S105 and the main controlling unit 61 continues to detect the home position of the disk 50*a*. If the 60 seconds timer has expired in step S106, Yes in step S106, a probable mechanical malfunction may be happening, and therefore the operation proceeds to step S107 and the main controlling unit 61 stops the rotation of the driving motor 38*a* and ends the position adjustment procedure. In that case, it is preferable to display an abnormality indication of the color printing apparatus 1 on the operational panel 6.

The color printing apparatus 1 also executes the position adjustment procedure when the condition that the sheet tray 31*a* or 31*b* is pulled out from the main housing 2 occurs while the color printing apparatus 1 is in operation. In step S110, the sheet tray 31*a* being pulled out from the main housing 2 is detected. Then, in step S102 the main controlling unit 61 detects that condition by the output signal of the tray set detector 63*a*. After the step S102, the aforementioned procedures of step S103 through step S107 are executed.

Accordingly at the time of pushing in the sheet tray 31*a*, the coupling groove 40*a* on the coupling 40*a* is precisely in the linkage position with the pin 37*a* on the shaft 35*a*. As a result, the pushing force for setting the sheet tray 31*a* to the main housing 2 is reduced, to meet the standard of the section 508 of the Rehabilitation act.

During the position adjustment procedure, it is possible that the sheet tray 31*a* is pushed into the main housing 2. In that case a contact between the pin 37*a* and the rotating coupling 39*a* could happen, and the contact could cause a mechanical failure of the sheet setting board 36*a* moving mechanism.

Figure 12:
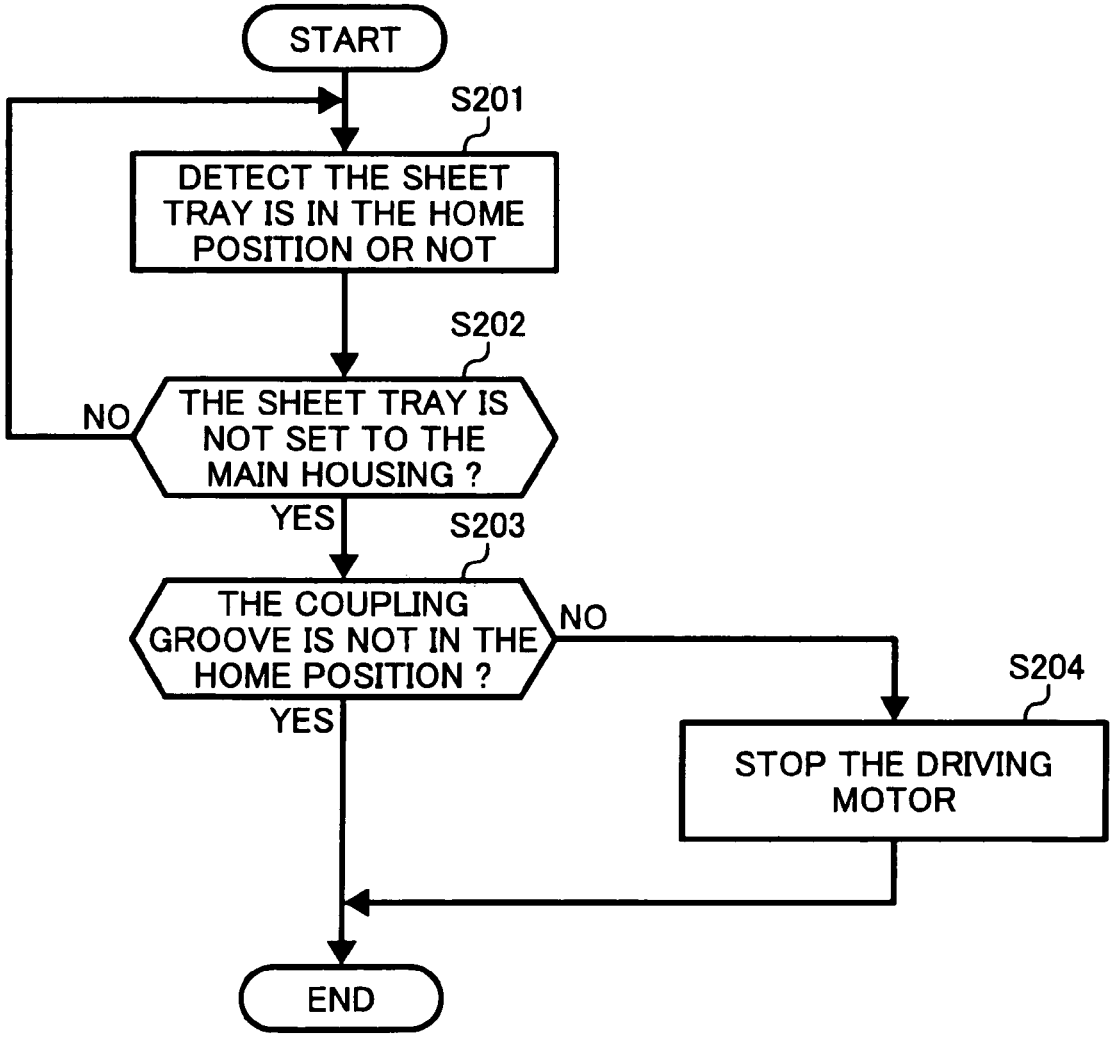
FIG. 12 is a flowchart illustrating a second embodiment of a position adjustment procedure.

To avoid such an inconvenience, the main controlling unit 61 executes the procedure shown in FIG. 12 during the position adjustment procedure shown in FIG. 11. In step S201 in FIG. 12, the main controlling unit 61 detects the state whether the sheet tray 31*a* is pulled out or set to the main housing 2 by the output signal of the tray set detector 63*a*. In step S202, if the main controlling unit 61 judges the sheet tray 31*a* is still pulled out from the main housing 2, Yes in step S202, then the operation returns to step S201 to continue to monitor the output signal of the tray set detector 63*a*. During the position adjustment procedure, if an operator pushes the sheet tray 31*a* into the main housing 2, then the pushing member 71 starts to push the switch 74. In step S202, before the sheet tray 31*a* is completely set to the main housing 2, the main controlling unit 61 detects that the sheet tray 31*a* is about to be set to the main frame 2 by the output signal from the tray set detector 63*a*. Then, in step S203, the main controlling unit 61 checks whether the coupling 39*a* is in the home position by the output signal of the home position detector 55. If the main controlling unit 61 detects the coupling 39*a* is not rotating and is in the home position, Yes in step S203, that means the position adjustment procedure has finished so the main controlling unit 61 does not do anything and finishes the procedure shown in FIG. 12. If the main controlling unit 61 detects the coupling 39*a* is rotating and is not in the home position, No in step S203, then the main controlling unit 61 stop rotating the coupling 39*a* immediately in step S204 and finishes the procedure.

By doing this, it is possible for the rotating coupling 39*a* to avoid colliding with the moving pin 37*a* and to incur mechanical stress. After the coupling 39*a* is stopped, even if the pin 37*a* collides with the coupling 39*a*, the coupling 39*a* absorbs an impact from the pin 37*a* by moving its position such as shown in FIG. 6. And after the sheet tray 31*a* is set to the main housing 2 completely, then the main controlling unit 61 starts rotating the coupling 39*a* again. Then, the position of the coupling groove 40*a* on the coupling 39*a* is made to coincide with the position of the pin 37*a*, and the linkage between the pin 37*a* and coupling groove 40*a* is restored.

Accordingly, since the pin 37*a* is aligned with the coupling 39, it is possible for the force to push in the sheet tray 31*a*, 31*b* to the main housing 2 to be reduced, and that makes use of the printing apparatus 1 easier, particularly for people with disabilities. That also makes it possible to avoid possible mechanical malfunctions by the collision between the rotating couplings 39*a*, 39*b* and the moving pins 37*a*, 37*b*.

As described above, the color printing apparatus 1 includes a linkage mechanism provided with the pins 37*a*, 37*b* on the shafts 35*a*, 35*b* in the sheet trays 31*a*, 31*b* and the couplings 39*a*, 39*b* with the coupling grooves 40*a*, 40*b* in the sheet feeder 5. And the sheet trays 31*a*, 31*b* can be detached at the linkage mechanism for the sheet supplying purpose. The color printing apparatus 1 also has the position detecting mechanism of the coupling groove 40*a*, 40*b* provided with the disks 50*a*, 50*b*, which rotates corresponding to the rotation of couplings 39*a*, 39*b*, and the home position detector 55, which detects the home position of the disks 50*a*, 50*b*.

Accordingly, by rotating driving motors 38*a*, 38*b* to rotate the couplings 39*a*, 39*b* to adjust the position of the coupling groove 40*a*, 40*b* to correspond the position to the pins 37*a*, 37*b* when the extraction of the sheet trays 31*a*, 31*b* occur to supply sheets to the sheet trays 31*a*, 31*b*, the force for setting the sheet trays 31*a*, 31*b* is reduced, and that improves usability of the printing apparatus and makes it easier to use for people with disabilities.

The color printing apparatus 1 stops the rotation of the driving motors 38*a*, 38*b* if the home position detector does not detect the home position of the disks 50*a*, 50*b* within the predetermined time after the start of the driving motors 38*a*, 38*b* rotation.

Accordingly, it also prevents unnecessary rotation of the driving motors 38*a*, 38*b*, which could happen by the possible mechanical failure.

The color printing apparatus 1 also stops the rotation of the driving motors 38*a*, 38*b* if the tray set detectors 63*a*, 63*b* detect that the sheet trays 31*a*, 31*b* are about to be set to the main housing 2 while the position adjustment procedure is executed.

Accordingly, it prevents the couplings 39*a*, 39*b* and the driving motors 38*a*, 38*b* having a huge mechanical stress by colliding with the pins 37*a*, 37*b* while rotating, which could cause mechanical failure.

Numerous additional modifications and variations are possible in a light of the above teachings. It is therefore to be understood that within the scope of the appended claims, the present invention may be practiced otherwise than as specifically described herein.

The invention claimed is:

1. A sheet feeding apparatus, comprising:

a sheet tray that is detachable and attachable to the sheet feeding apparatus, the sheet tray comprising:

a first linkage member including a pin, and a sheet setting board configured to pivot by a rotation of the first linkage member and to be lifted to a feeding position where an uppermost sheet of a plurality of sheets on the sheet setting board can be fed to a printing apparatus, the sheet setting board being at a lowermost position when the sheet tray is being detached from or inserted into the sheet feeding apparatus;

a second linkage member including a groove configured to link to the pin of the first linkage member and configured to convey a rotating force to the first linkage member;

a motor configured to rotate the second linkage member;

a controller configured to control the motor to rotate the second linkage member so that a position of the groove of the second linkage member is aligned with a corresponding position of the pin of the first linkage member when the sheet setting board is at the lowermost position and the sheet tray is being detached from or inserted into the sheet feeding apparatus;

a home position detector, which detects a home position of the second linkage member, and wherein the controller controls the motor to move the second linkage member to the home position during the sheet tray being detached from the sheet feeding apparatus;

a tray set detector, which detects whether the sheet tray is detached from the sheet feeding apparatus or not, wherein the controller controls the motor to meet a position of the second linkage member corresponding to a position of the first linkage member when the tray set detector detects that the sheet tray is detached from the sheet feeding apparatus after the printing apparatus has been turned on, and wherein the controller stops the motor rotation, if the home position detector does not detect that the second linkage member is in the home position within a predetermined time.

2. A sheet feeding apparatus according to claim 1, wherein the controller stops the motor rotation if the tray set detector detects that the sheet tray is not detached from the sheet feeding apparatus.

3. A sheet feeding apparatus according to claim 1, wherein in the first linkage member the pin is attached to a shaft that is a center of pivoting of the sheet setting board.

4. A printing apparatus, comprising:

a sheet feeder, the sheet feeder comprising:

a sheet tray detachable and attachable to the sheet feeder;

a first linkage member including a pin;

a sheet setting board configured to pivot by a rotation of the first linkage member and to be lifted to a feeding position where an uppermost sheet of a plurality of sheets on the sheet setting board can be fed to the printing apparatus, the sheet setting board being at a lowermost position when the sheet tray is being detached from or inserted into the sheet feeding apparatus;

a second linkage member including a groove configured to link to the pin of the first linkage member and configured to convey a rotating force to the first linkage member;

a motor configured to rotate the second linkage member;

a controller configured to control the motor to rotate the second linkage member so that a position of the groove of the second linkage member is aligned with a corresponding position of the pin of the first linkage member when the sheet setting board is at the lowermost position and the sheet tray is being detached from or inserted into the sheet feeding apparatus;

a home position detector, which detects a home position of the second linkage member, wherein the controller controls the motor to move the second linkage member to the home position during the sheet tray being detached from the sheet feeding apparatus;

a tray set detector, which detects whether the sheet tray is detached from the sheet feeder, wherein the controller controls the motor to meet a position of the second linkage member corresponding to a position of the first linkage member when the tray set detector detects that the sheet tray is detached from the sheet feeder after the printing apparatus has been turned on, and wherein the controller stops the motor rotation, if the home position detector does not detect that the second linkage member is in the home position within a predetermined time.

5. A sheet printing apparatus, comprising:

a sheet feeder, the sheet feeder comprising:

a sheet tray detachable and attachable to the sheet feeder;

a first linkage member including a pin;

a sheet setting board configured to pivot by a rotation of the first linkage member and to be lifted to a feeding position where an uppermost sheet of a plurality of sheets on the sheet setting board can be fed to the printing apparatus, the sheet setting board being at a lowermost position when the sheet tray is being detached from or inserted into the sheet feeding apparatus;

a second linkage member including a groove configured to link to the pin of the first linkage member and configured to convey a rotating force to the first linkage member;

a motor configured to rotate the second linkage member, a controller configured to control the motor to rotate the second linkage member so that a position of the groove of the second linkage member is aligned with a corresponding position of the pin of the first linkage member when the sheet setting board is at the lowermost position and the sheet tray is being detached from or inserted into the sheet feeding apparatus;

a home position detector, which detects a home position of the second linkage member, wherein the controller controls the motor to move the second linkage member to the home position during the sheet tray being detached from the sheet feeding apparatus;

a tray set detector, which detects whether the sheet tray is detached from the sheet feeder, wherein the controller controls the motor to meet a position of the second linkage member corresponding to a position of the first linkage member when the tray set detector detects that the sheet tray is detached from the sheet feeder after the printing apparatus has been turned on, and wherein the controller stops the motor rotation, if the tray set detector detects that the sheet tray is not detached from the sheet feeder.

6. A printing apparatus according to claim 4, wherein in the first linkage member the pin is attached to a shaft that is a center of pivoting of the sheet setting board.

7. A printing apparatus according to claim 5, wherein in the first linkage member the pin is attached to a shaft that is a center of pivoting of the sheet setting board.

* * * * *